US005336543A

United States Patent [19]

Pyle

[11] Patent Number: 5,336,543

[45] Date of Patent: Aug. 9, 1994

[54] HAIR DRYING TOWEL

[76] Inventor: Norman R. Pyle, 2817 S. Walkers Mill Rd., Griffin, Ga. 30223

[21] Appl. No.: 918,916

[22] Filed: Jul. 23, 1992

Related U.S. Application Data

[63] Continuation-in-part of Ser. No. 551,284, Jul. 12, 1990, abandoned.

[51] Int. Cl.[5] ..... D03D 27/08; B32B 3/14; B32B 5/14

[52] U.S. Cl. ..... 428/78; 139/383 R; 139/396; 428/77; 428/85; 428/89; 428/95; 428/102; 428/170; 428/171; 428/190; 428/257

[58] Field of Search ..... 139/25, 396, 383 R; 26/18.5, 2 R; 428/85, 95, 89, 224, 78, 11, 79, 102, 12, 170, 171, 190, 257; 8/115

[56] References Cited

U.S. PATENT DOCUMENTS

| | | | |
|---|---|---|---|
| D. 56,824 | 12/1920 | Margerison et al. | D6/608 |
| D. 74,621 | 7/1925 | O'Keefe | D6/608 |
| D. 275,827 | 10/1984 | Henry | D6/608 |
| 745,112 | 3/1903 | Margerison | 139/396 |
| 1,930,769 | 2/1932 | Parker | 139/396 |
| 1,949,579 | 3/1934 | Parker | 139/396 |
| 2,988,800 | 1/1958 | White | 28/72 |
| 3,030,691 | 3/1960 | Law | 428/89 |
| 3,666,608 | 5/1972 | Mattes | 161/62 |
| 3,669,818 | 6/1970 | Stark | 161/63 |
| 3,721,272 | 3/1973 | Hager | 139/396 |
| 4,215,987 | 8/1980 | Mueller et al. | 8/115 |
| 4,576,848 | 3/1986 | Dillon et al. | 428/89 |
| 4,671,568 | 6/1987 | Greer | 257/229 |
| 4,726,400 | 2/1988 | Heiman | 139/396 |
| 4,885,195 | 12/1989 | Change, III | 428/36.1 |
| 4,984,606 | 1/1991 | Moore et al. | 428/85 |

FOREIGN PATENT DOCUMENTS

| | | | |
|---|---|---|---|
| 207139 | 12/1939 | Switzerland | D6/L428 608 |
| 665546 | 5/1988 | Switzerland . | |

*Primary Examiner*—James D. Withers

[57] ABSTRACT

A towel for wrapping and drying hair on a human head includes a configuration for facilitating wrapping of the towel about the head and also provides for an area of enhanced water absorption for contacting the hair and for facilitating rapid drying thereof.

6 Claims, 4 Drawing Sheets

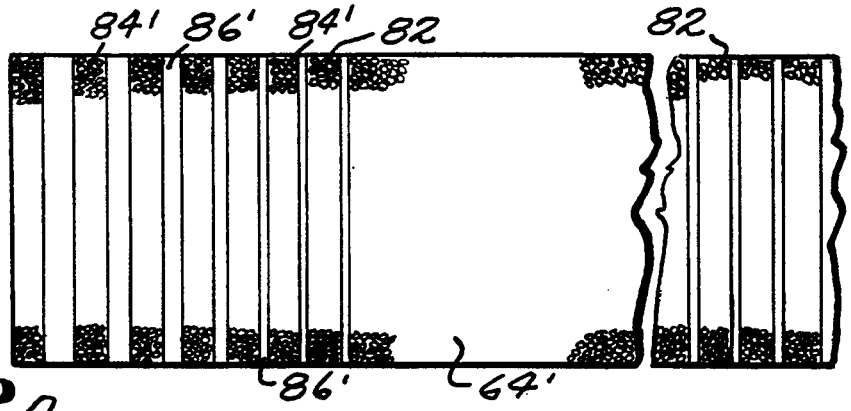
Fig. 2A.
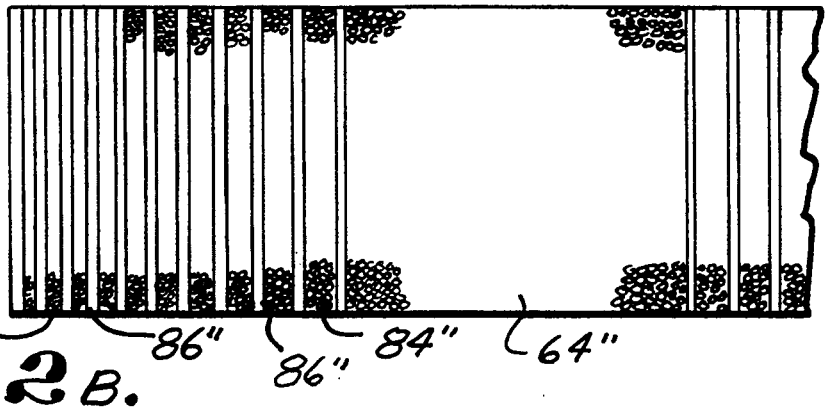
Fig. 2B.
Fig. 4.
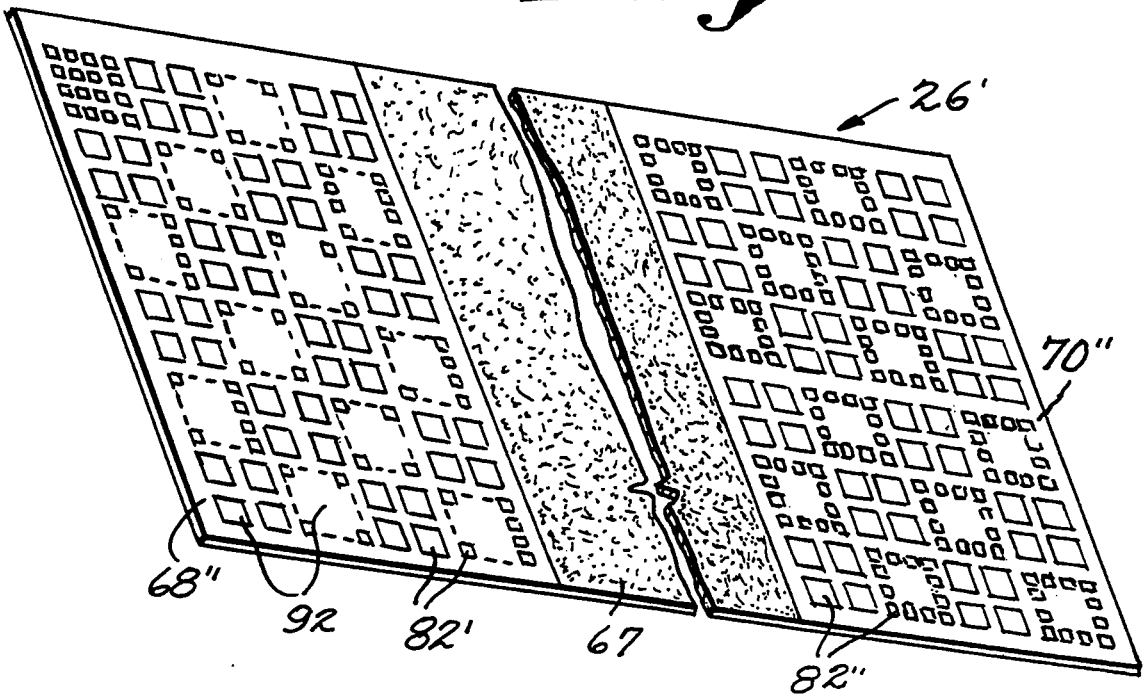

HAIR DRYING TOWEL

This application is a continuation-in-part of prior application Ser. No. 07/551,284 filed on Jul. 12, 1990 of Norman R. Pyle for Hair Drying Towel, now abandoned.

This invention relates to a towel and more particularly to a hair drying towel constructed to facilitate wrapping of the towel about a human head and for rapidly drying hair.

An object of the present invention is to provide a towel for wrapping and drying hair on a human head.

Another object is to provide such a towel which is shaped or woven to make end portions of the towel lighter in weight than a central portion of the towel for facilitating wrapping and drying hair on a human head.

A further object of the invention is the provision of such a towel having end portions which are less bulky and lighter in weight than a central portion of the towel for facilitating wrapping of the towel about a human head.

Still another object is to provide such a towel in which end portions of the towel are designed to drape better and more evenly when wrapped about a human head.

A still further object is to provide such a towel in which end portions of the towel can be readily tucked when the towel is wrapped around the head.

Another object is to provide such a towel in which a central portion is more water-absorbent than end portions.

Still another object is to provide such a towel in which a heavier and more water-absorbent portion is positioned at a lower marginal area of the middle part of the towel to absorb more water from hair on the back of the head and the sides of the head.

A still further object is to provide such a towel that is economical to manufacture.

Another object is to provide such a towel which has a reduced overall weight and which also efficiently absorbs water and dries hair.

To achieve these and other objects the present invention provides a towel for wrapping and drying hair on a human head including a cloth having front and back sides and defining a central portion having a first predetermined weight per a first predetermined unit area. The cloth further defines first and second end portions having end boundaries, and the end portions are attached to the central portion. Each of the end portions has a second predetermined weight per said unit area which is uniformly less than the first predetermined weight over the entire end portions whereby wrapping the towel about the head and drying of hair on the head is facilitated.

It is to be understood that both the foregoing general description and the following detailed description are exemplary and explanatory but are not restrictive of the invention.

The accompanying drawings, which are incorporated in and constitute a part of this specification, illustrate examples of preferred embodiments of the invention and, together with the description, serve to explain the principles of the invention.

FIG. 2A is a fragmentary plan view of an alternative embodiment of the invention;

FIG. 2B is a fragmentary plan view of another embodiment of the invention;

FIG. 4 is a fragmentary perspective view of another invention embodiment;

Figure 1:
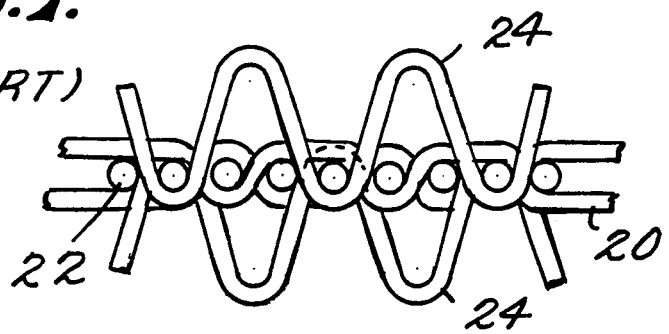
Fig. 1. (PRIOR ART)
FIG. 1 is a fragmentary cross-sectional view of a prior an terry fabric.

With reference now to the drawings, wherein like reference characters designate like or corresponding parts throughout the several views, there is shown in FIG. 1 a fragmentary cross section of a conventional terry fabric. All woven fabrics are constructed of two series of yarns. The warp is the series of parallel threads running lengthwise of the fabric, and the filling is the series of parallel threads running across the cloth at fight angles to the warp. A single thread of the warp is known as a warp end, or simply an end, and a single thread of the filling is known as a pick. By the weaving process, the picks of the filling are interlaced with the ends of the warp to produce a woven fabric of a texture depending, to a great extent, on the method of interlacing. In a terry weave, a pile is formed by additional threads, known as pile warp or pile filling. The foundation fabric to which the pile is attached is comprised of warp threads and filling threads identified as the ground warp and the ground filling, respectively.

FIG. 1 shows a conventional terry fabric comprised of ground ends or warp ends 20 interlaced with a plurality of ground fillings or picks 22. As shown in FIG. 1, the pile of the terry fabric is comprised of a plurality of pile ends or pile warp ends 24 which are attached to the ground or base fabric and which are interlaced with picks 22.

As is well known in the art, the terry pile may be of different height, and the terry pile may be cut or uncut to provide a different feel and appearance for the fabric.

Figure 2:
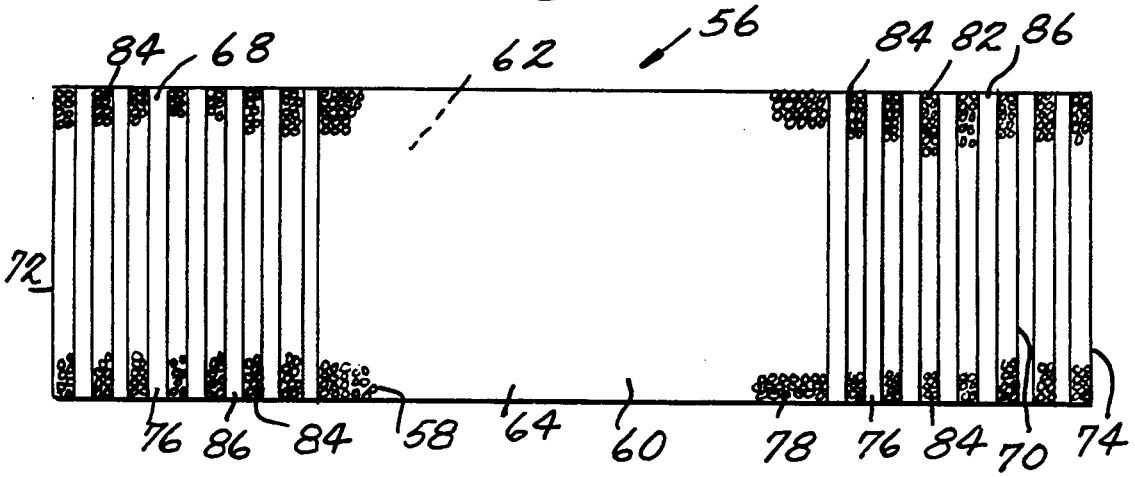
FIG. 2 is a plan view of one embodiment of the invention.
Figure 3:
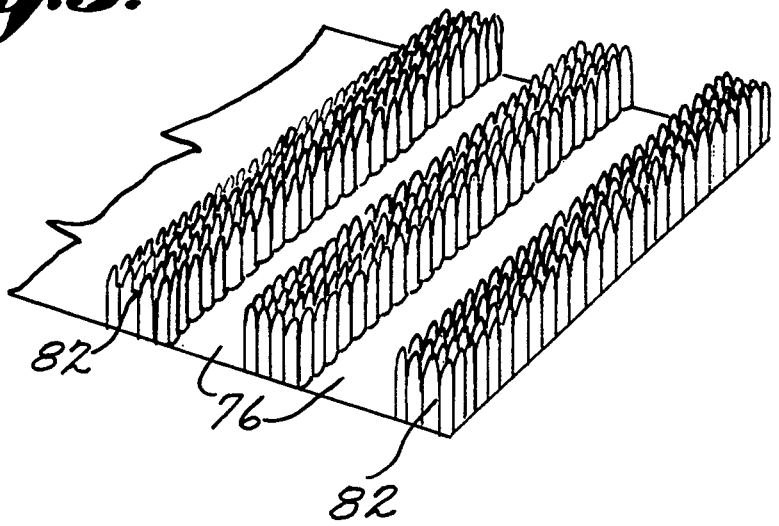
FIG. 3 is a fragmentary perspective view of a portion of the towel shown in FIG. 2.

With reference now to FIGS. 2 and 3, there is shown one embodiment of this invention which is comprised of terry towel 56. Towel 56 is comprised of a cloth 58 having front and back sides 60, 62. Cloth 58 defines a central portion 64 having a rust predetermined weight per a first predetermined unit area 66. Cloth 58 further defines first and second end portions 68, 70. End portion 68 defines a first end boundary or edge 72 of towel 56, and second end portion 70 defines a second end boundary or edge 74 of towel 56.

End portions 68, 70 are attached to central portion 64 in a conventional manner so that the same base or ground fabric 76 forms the base or ground for central portion 64 and for end portions 68, 70. Each of end portions 68, 70 is of a second predetermined weight per the same unit area 66 which is uniformly less than the predetermined weight of central portion 64 per unit area 66. The lighter weight of end portions 68, 70 is uniformly less than that of central portion 64 over the entire areas of end portions 68, 70. As a result, it is easier to wrap and to tuck the lighter weight end portions 68, 70 more easily at the top or back of the head when towel 56 is draped about a human head. The heavier weight of central portion 64 provides for increased water absorbency, and it is the central portion which contacts the back and side portions of the human head and the hair to be dried.

More specifically, because of the increased weight and bulk of central portion 64 with respect to end portions 68, 70, the water absorbency of central portion 64 is greater than that of end portions 68, 70 within each unit area 66. The greater weight and water absorbency of central portion 64 is provided by having a first pile 78 attached to base fabric 76 and substantially completely covering central portion 64 of the towel and on the front and back sides 60, 62 thereof.

In the invention embodiment illustrated in FIG. 2, end portions 72, 74 include a pile 82 of substantially the same height as pile 78. Pile 82 is attached to base fabric 76 in a conventional manner and covers at least thirty percent of end portions 72, 74 less than the entire areas of end portions 72, 74 on front and back sides 60, 62. More specifically, pile 82, as shown in FIG. 2, defines a plurality of substantially parallel strips 84, and each of strips 84 is separated from an adjacent strip by an area or strip 86 of base fabric 76 which has no pile attached to base fabric 76. As shown in FIG. 2, strips 84 of pile 82 are substantially equally spaced apart from each other.

As shown in FIG. 2A, the width of strips 86' between 84' of pile 82 can increase in a predetermined manner from central portion 64' toward each of the end boundaries of the towel. Also, this arrangement of strips gradually reduces the weight per unit area from central portion to the end boundaries of end portions. In this embodiment, the width of each of strips 84' is substantially equal to the width of each of the other strips 84'.

Another embodiment of the invention, as shown in FIG. 2B, provides for the width of each of pile strips 84'' to decrease in a predetermined manner from central portion 64'' of the towel toward each of the end boundaries of the towel. In this embodiment, each of strips 86'' of no pile is of equal width as all other strips 86''. For embodiments in FIGS. 2, 2A and 2B, the Found filling of the base fabric within the end portions has the same weight and number of ground filling picks per unit area as the central portion. Also, the weight and number of ground filling picks are the same per unit area for the entire end portions.

Figure 6:
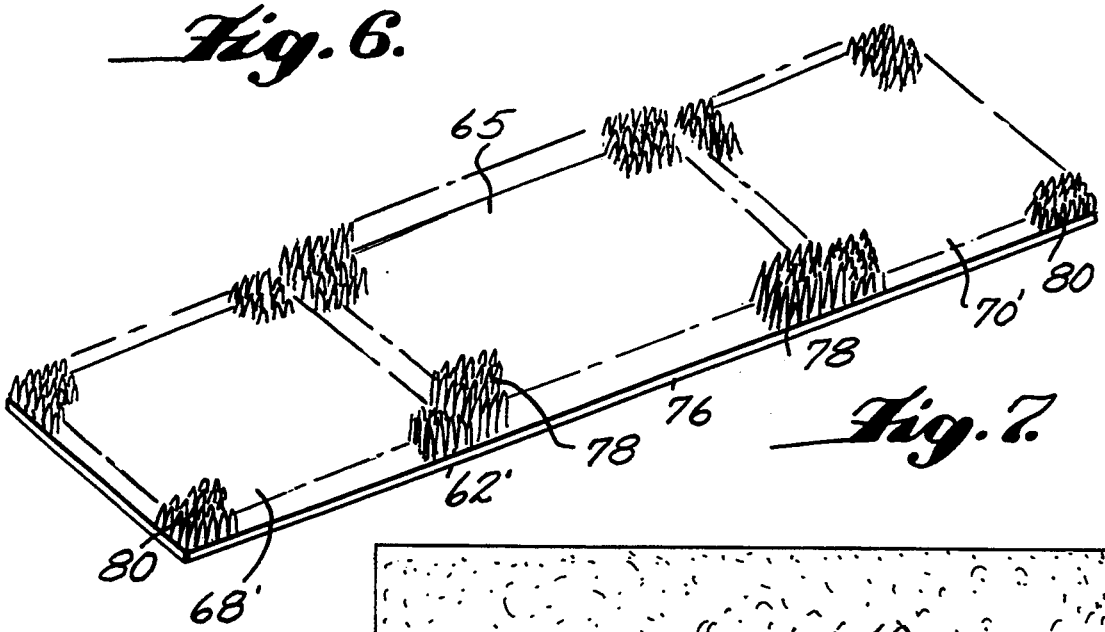
FIG. 6 is a fragmentary perspective view of another invention embodiment.

As illustrated in FIG. 6, another embodiment of this invention provides for each of end portions 68', 70' to include a pile 80 of a second predetermined height less than the height of first pile 78 within central portion 65 of the towel. Pile 80 is attached to base fabric 76 in a conventional manner and completely covers end portions 68', 70' on front and back sides 60', 62'. The shorter pile 80 on end portions 68', 70' enables the end portions to more readily tuck and fold about the top or back of the head where they are crossed to facilitate wrapping of the towel about the head. The greater water absorbency provided by the higher and heavier pile of central portion 65 enhances the drying characteristics of the central portion of the towel which contacts the hair when the towel is wrapped about the head. The length of the pile within the end portions can be at least substantially twenty percent less than the pile of the central portion. The length of central portion preferably can be substantially thirty percent to sixty percent of overall towel length, providing an amount sufficient to surround back and sides of head. Further, the weight and number of ground filling picks within the base fabric of central portion will be at least equal to the end portions. Preferably the end portions and central portion include the same 3 pick weave as illustrated in FIG. 1.

Although not illustrated, it should be understood that various types of designs may be formed within pile 80 on end portions 68', 70'. These designs, for example, could be formed by cutting some of the pile loops within pile 80 to form the predetermined designs, or pile 80 could be attached only to predetermined areas of base fabric 76 to form any desired design.

Figure 5:
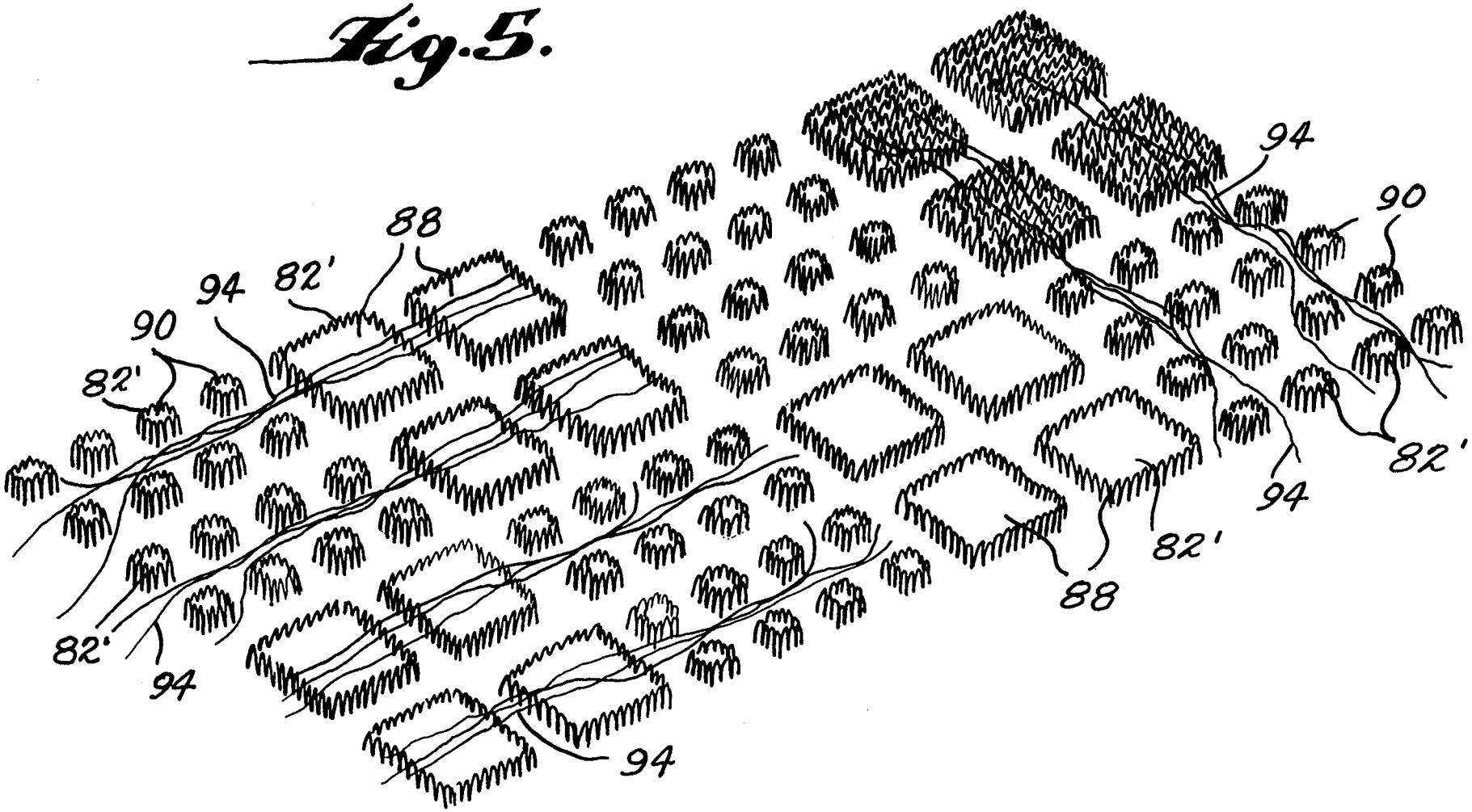
FIG. 5 is a fragmentary perspective view of a portion of the pile design shown in FIG. 4.

Another embodiment of the invention is illustrated in FIGS. 4 and 5 wherein end portions 68'', 70'' of towel 26', which are partially covered by pile 82', include four substantially square areas 88 of pile 82' of a first predetermined height and substantially equally spaced apart from each other. Sixteen square areas 90 of pile 82', which are substantially the same height as pile 82' within areas 88, are also provided, and the area of each of square areas 90 is smaller than the area of each of square areas 88. Each of areas 90 is substantially equally spaced apart from each other, and sixteen areas 90 are positioned adjacent to four areas 88 to form, in combination with areas 88, a predetermined pile configuration 92. The area defined by sixteen squares 90 and the spaces between those squares 90 is substantially equal in size to the area defined by four squares 88 and the spaces between those squares 88.

Each of end portions 68'', 70'' of towel 26' defines a plurality of pile configurations 92 positioned adjacent of each other, as illustrated in FIGS. 4 and 5, whereby drying and separating of the hair can be effectively achieved by passing hair 94 over and through pile areas 88, 90 of pile configurations 92.

The small squares 90 separates the hair with a combing action drying substantially the sides of hair 94, then the hair is delivered to the larger squares 88 which drys substantially top and bottom of the hair. Preferably, pile configurations 92 are located on front and back sides 60', 62' of end portions 68'', 70''. Central portion 67 of towel 26' is constructed in the same manner as central portion 64 in the embodiment shown in FIG. 2, and the height of the pile in central portion 67 can be equal to or greater than the height of pile 82' in pile area 88, 90 to provide for greater water absorbency within central portion 67 than within end portions 68'', 70''.

Figure 7:
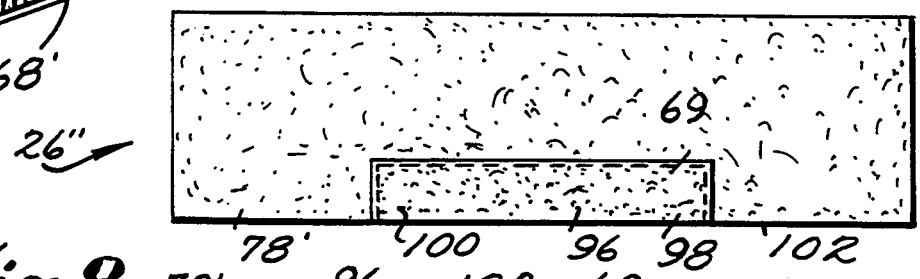
FIG. 7 is a plan view of an alternative embodiment of the invention.
Figure 8:
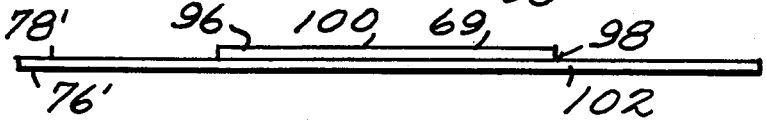
FIG. 8 is an elevation view of the towel embodiment shown in FIG. 7.
Figure 9:
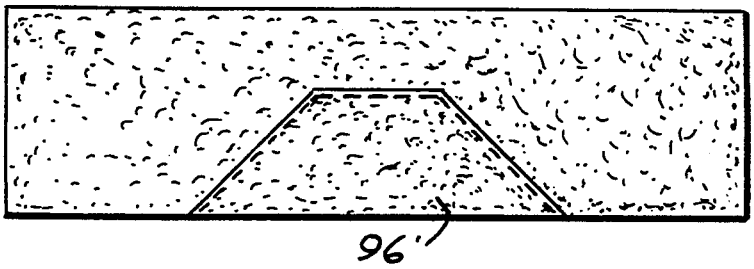
FIG. 9 is a plan view of another invention embodiment.

Other embodiments of the invention are illustrated in FIGS. 7–9 wherein a water-absorbing enhancing element 96 includes a second base fabric 98 which is formed in a conventional manner, as illustrated in FIG. 1. A pile 100 is attached to base fabric 98 in the conventional manner illustrated in FIG. 1, and pile 100 substantially completely covers one or both sides of base fabric 98. Enhancing element 96 is attached to base fabric 76' and over pile 78' to form central portion 69 of the towel 26''. Element 96 is preferably sewn onto fabric 76' in a conventional manner with pile 100 coveting the exposed side of element 96.

Typically, the fabric of element 96 will be the same as the fabric of base 76 and pile 78 in the embodiment of FIG. 6. However, the fabric of element 96 can be heavier or lighter than the fabric in base 76 and in pile 78. Alternately, a material that is even more water-absorbent than the material of base 76 and pile 78 can be used to provide increased water absorbency in the back of the head and the sides of the head when towel 26'' is wrapped around the head.

As shown in FIGS. 7 and 8, enhancing element 96 is preferably attached along a marginal or side boundary 102 of towel 26'', and enhancing element 96 can be substantially rectangular in configuration. As shown in FIG. 9, enhancing element 96' can be substantially trapezoidally shaped to increase the area of greater water absorbency at the back of the head and to gradually decrease the area of greater water absorbency along the sides and toward the front of the head when the towel is wrapped about the head. The enhancing element preferably can be seven percent to seventeen percent of the overall square area of the towel being located in the center of a side boundary.

Another embodiment of the invention, which increases the water absorbency of the central portion of the towel with respect to the end portions thereof, provides that base fabric 76 within the central portion of the towel has a greater weight per unit area than the weight of base fabric 76 within end portions of the towel. This can be accomplished by increasing the weight of the Found filling picks in the base fabric 76 within the central portion of the towel. Also, the weight of the base fabric can be increased by adding a greater number of ground filling picks, further both end portions and central portion preferably have a 3 pick weave. This will result in an increased weight of the towel per unit area within the central portion of the towel and will result in increased water absorbency of the towel within the central portion thereof. The end portions of the towel will be lighter in weight than the central portion to facilitate wrapping of the towel about the head.

Figure 10:
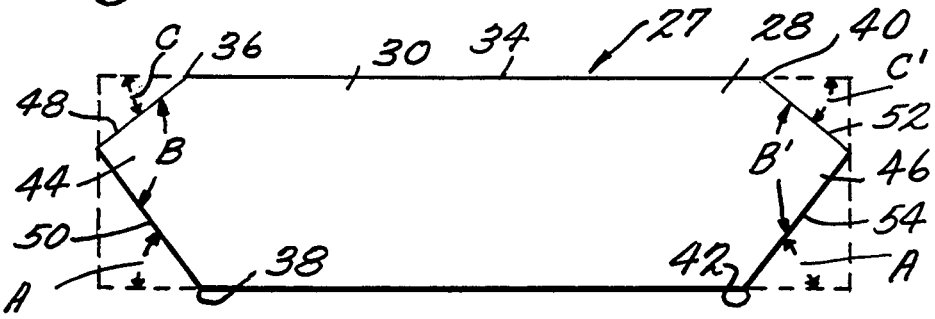
FIG. 10 is a plan view of still another embodiment of the invention.

With reference now to FIG. 10, there is shown a towel 27 in accordance with another embodiment of this invention which includes a conventional terry cloth 28, such as that described and illustrated in FIG. 1. Cloth 28 defines a central, quadrilaterally-shaped portion 30, which is defined by sides or edges 32, 34 and by the imaginary boundaries extending in straight lines between corners 36, 38 and between comers 40, 42. Cloth 28 further defines first and second triangularly-shaped end portions 44, 46. End portion 44 is defined by sides 48, 50 and by the imaginary line extending between comers 36, 38. Likewise, end portion 46 is defined by sides 52, 54 and by the imaginary line extending between comers 40, 42.

The shapes of end portions 44, 46 can be varied by varying the magnitudes of angles A, B, C of end portion 44 and A', B', C' of end portion 46. Angles 44 and 46 located at defining end boundaries can be preferably 75 to 120 degrees, creating a long side 34 and a short side 32, the long side 34 is at least 15 percent greater in length than shorter side 32. Long sides 50, 54 of angles 44 and 46 are at least one and one-half times greater in length than shorter sides 48 and 52. Further, in using the towel, the longer side 34 is positioned at back of head and the shorter side is positioned at top and front of head. Triangularly-shaped end portions 44, 46 of towel 27 reduce the weight and bulk of the end portions and permit the towel to be wrapped, tucked and draped more evenly and more readily at the top or back of the head where they are crossed.

For optimum drying characteristics, convenience and efficiency of wrapping and tucking of the towel about the head, the length of each end portion of each of the towel embodiments illustrated in FIGS. 2–6 is preferably from eighteen to thirty-five percent of the overall length of the towel.

This invention provides a terry towel which is specifically designed for wrapping and drying hair on a human head. The end portions of the towel are shaped or woven to make them lighter in weight and greater in flexibility than the central portion of the towel. As a result, the central portion of the towel is more water-absorbent than the end portions of the towel, and it is easier to wrap the towel about the head and to cross over and tuck the end portions of the towel in the wrapping process.

The invention in its broader aspects is not limited to the specific details shown and described, and departures may be made from such details without departing from the principles of the invention and without sacrificing its chief advantages.

What is claimed is:

1. A towel for wrapping and drying hair on a human head, said towel comprising:

a cloth having front and back sides, a central portion having a weight per unit area and end portions attached to said central portion, each of said end portions having a weight per unit area uniformly less than the weight per unit area of said central portion;

the flexibility of said end portions being greater than the flexibility of said central portion;

the water absorbency per unit area of said central portion being greater than the water absorbency per unit area of each of said end portions;

said cloth comprising a first base fabric and a first pile of first height attached to said first base fabric and substantially completely covering said central portion on said front and back sides; and a water-absorbing enhancing element comprising a second base fabric and a second pile attached to said second base fabric and substantially completely covering a first side of said second base fabric, said enhancing element attached to said first base fabric by sewing said enhancing element peripheral boundaries to said first base fabric and over a portion of said first pile within said central portion of said towel, said enhancing element being attached along a side boundary of said towel.

2. A towel as in claim 1 wherein said enhancing element is substantially rectangular in configuration.

3. A towel as in claim 1 wherein said enhancing element is substantially trapezoidally shaped.

4. A towel as in claim 1 wherein said enhancing element covers seven percent to seventeen percent of the overall area of said towel.

5. A towel for wrapping and drying hair on a human head, said towel comprising:

a cloth having front and back sides, a central portion having a weight per unit area and end portions attached to said central portion, each of said end portions having a weight per unit area uniformly less than the weight per unit area of said central portion;

the water absorbency per unit area of said central portion being greater than the water absorbency per unit area of each of said end portions;

said cloth comprising a base fabric and a pile attached to said base fabric and substantially completely covering said central portion of said base fabric on said front and back sides;

said base fabric within said central portion having a greater weight per unit area than said base fabric within said end portions;

said towel consisting essentially of a 3-pick terry weave.

6. A towel for wrapping and drying hair on a human head, said towel comprising:

a cloth having front and back sides, a central portion having a weight per unit area and end portions attached to said central portion, each of said end portions having a weight per unit area uniformly less than the weight per unit area of said central portion;

the water absorbency per unit area of said central portion being greater than the water absorbency per unit area of each of said end portions;

said cloth comprising a base fabric and a pile attached to said base fabric and substantially completely covering said central portion of said base fabric on said front and back sides;

said towel wherein the weight of the ground filling picks is greater within said base fabric of said central portion than said end portions.

* * * * *